US009815189B1

(12) United States Patent
Liu

(10) Patent No.: US 9,815,189 B1
(45) Date of Patent: Nov. 14, 2017

(54) TOOL CABINET

(71) Applicant: Chia-Ming Liu, Douliou (TW)

(72) Inventor: Chia-Ming Liu, Douliou (TW)

( * ) Notice: Subject to any disclaimer, the term of this patent is extended or adjusted under 35 U.S.C. 154(b) by 0 days.

(21) Appl. No.: 15/658,515

(22) Filed: Jul. 25, 2017

Related U.S. Application Data

(63) Continuation-in-part of application No. 15/353,001, filed on Nov. 16, 2016.

(30) Foreign Application Priority Data

Aug. 31, 2016 (CN) ..... 2016 2 1015361 U
Apr. 21, 2017 (CN) ..... 2017 2 0424645 U

(51) Int. Cl.

| | |
|---|---|
| ***A47B 46/00*** | (2006.01) |
| ***B25H 1/16*** | (2006.01) |
| ***B25H 3/00*** | (2006.01) |
| ***A47B 9/04*** | (2006.01) |
| ***B25H 1/12*** | (2006.01) |
| ***A47B 83/00*** | (2006.01) |
| ***A47B 96/00*** | (2006.01) |

(52) U.S. Cl.
CPC ..... *B25H 1/16* (2013.01); *A47B 9/04* (2013.01); *A47B 83/00* (2013.01); *A47B 96/00* (2013.01); *B25H 1/12* (2013.01); *B25H 3/00* (2013.01); *A47B 2009/046* (2013.01)

(58) Field of Classification Search
CPC ..... A47B 9/04; A47B 83/00; A47B 96/00; A47B 13/00; A47B 37/00; A47B 45/00; A47B 46/00; B25H 1/12; B25H 1/16; B25H 3/00
USPC ..... 312/196, 306, 312, 317.3, 319.5, 223.3, 312/902; 108/59, 106, 147.19
See application file for complete search history.

(56) References Cited

U.S. PATENT DOCUMENTS 654,922 A * 7/1900 Schipkowsky ..... A47B 17/036 312/196
742,118 A * 10/1903 Huddleston ..... A47B 31/00 108/17
1,099,521 A * 6/1914 Sprung ..... E05B 65/0003 312/196
1,247,590 A * 11/1917 Sprung ..... A47B 51/00 312/196
1,459,930 A * 6/1923 Riehle ..... B25H 1/04 144/285
2,019,455 A * 10/1935 Lehman ..... A47B 17/02 312/196

(Continued)

*Primary Examiner* — James O Hansen
(74) *Attorney, Agent, or Firm* — Trop Pruner & Hu, P.C.

(57) ABSTRACT

A tool cabinet includes a cabinet body having two guide rails, a movable working platform unit having two extension members that are respectively coupled to the guide rails, two lifting units, and a driving unit. Each extension member has an inner coupling hole. Each lifting unit has a support member, a threaded rod, and a threaded member movably and threadedly engaging the threaded rod. Rotation of the threaded rods results in the movement of the working platform unit between lowered and lifted positions. When the working platform unit is arrested in the middle of being driven from the lifted position to the lowered position while the driving unit continues to operate, the rotation of the threaded rod drives the threaded member to slide away from the support member.

8 Claims, 8 Drawing Sheets

(56) References Cited

U.S. PATENT DOCUMENTS

| | | | | | |
|---|---|---|---|---|---|
| 2,931,685 | A * | 4/1960 | Myra | A47B 17/02 | 108/32 |
| 3,245,741 | A * | 4/1966 | Bartlett | A47B 17/02 | 312/196 |
| 3,297,387 | A * | 1/1967 | Parsons | A47B 29/00 | 112/217.1 |
| 4,740,044 | A * | 4/1988 | Taylor | A47B 21/03 | 312/196 |
| 5,129,611 | A * | 7/1992 | Grover | F16M 11/42 | 108/147 |
| 6,213,575 | B1 * | 4/2001 | Brin, Jr. | A47B 77/04 | 108/147 |
| 6,312,069 | B1 * | 11/2001 | Weng | A47B 9/06 | 108/147 |
| 6,634,668 | B2 * | 10/2003 | Urffer, III | A47F 5/108 | 280/47.35 |
| 8,033,620 | B2 * | 10/2011 | Retchloff | B25H 3/00 | 312/290 |
| 2002/0101139 | A1 * | 8/2002 | Lee | A47B 21/0073 | 312/196 |
| 2003/0106614 | A1 * | 6/2003 | Noden | B25H 1/16 | 144/286.1 |
| 2005/0046315 | A1 * | 3/2005 | Doane | A47B 17/02 | 312/196 |
| 2012/0025681 | A1 * | 2/2012 | Ton | A47B 46/00 | 312/309 |
| 2013/0088131 | A1 * | 4/2013 | Messing | A47B 51/00 | 312/247 |
| 2014/0217861 | A1 * | 8/2014 | Cole | A47B 45/00 | 312/205 |

* cited by examiner

TOOL CABINET

CROSS-REFERENCE TO RELATED APPLICATION

This application is a continuation-in-part of co-pending U.S. patent application Ser. No. 15/353,001, filed by the applicant on Nov. 16, 2016, which claims priority of Chinese Patent Application No. 201621015361.4 filed on Aug. 31, 2016. This application also claims priority of Chinese Patent Application No. 201720424645.7, filed on Apr. 21, 2017.

FIELD

The disclosure relates to a tool cabinet, and more particularly to a tool cabinet that has a height-adjustable working platform.

BACKGROUND

Referring to FIG. 1, a conventional tool cabinet as disclosed in Chinese Patent No. 204868803U includes a cabinet body 1, a working platform unit 2 disposed on the cabinet body 1, two lifting units 3 (only one is shown) respectively disposed at opposite sides of the cabinet body 1 and connected to the working platform unit 2, a linkage unit 4 interconnecting the lifting units 3, and a driving unit 5 disposed on the working platform unit 2. The cabinet body 1 includes two slide rails 101. The working platform unit 2 has two extension members 201 respectively and slidably inserted into the slide rails 101. Each of the lifting units 3 has a guide tube 301, a nut 302 that is disposed on a top end of the guide tube 301, a threaded rod 303 that is rotatably connected to the working platform unit 2 and that is threadedly connected to the nut 302, and a transmission bevel gear 304 that is disposed on a top end of the threaded rod 303. The linkage unit 4 includes a linkage rod 401, and two linkage bevel gears 402 that are respectively connected to opposite ends of the linkage rod 401, and that respectively mesh with the transmission bevel gears 304 of the lifting units 3. The driving unit 5 includes a motor 501, and a drive bevel gear 502 that is connected to the motor 501, and that meshes with the transmission bevel gear 304 of one of the lifting units 3.

When lifting or lowering the working platform unit 2, a user needs to start the motor 501 to drive rotation of the threaded rod 303 of the one of the lifting units 3 via the engagement between the drive bevel gear 502 and the transmission bevel gear 304 of the one of the lifting units 3. During the abovementioned rotation of the threaded rod 303, the transmission bevel gear 304 of the one of the lifting units 3 simultaneously drives rotation of the linkage rod 401 via the engagement between the transmission bevel gear 304 of the one of the lifting units 3 and a corresponding one of the linkage bevel gears 402, thereby driving rotation of the threaded rod 303 of the other one of the lifting units 3 (not shown in FIG. 1) via the engagement between the other one of the linkage bevel gears 402 and the transmission bevel gear 304 of the other one of the lifting units 3 (not shown in FIG. 1). For each of the lifting units 3, since the rotation of the threaded rod 303 results in telescopic movement of the threaded rod 303 relative to the guide tube 301 via the engagement between the threaded rod 303 and the nut 302, the working platform unit 2 can eventually be moved upwardly and downwardly along the slide rails 101.

However, when in use, unlike the threaded rod 303 of the one of the lifting units 3, rotation of the threaded rod 303 of the other one of the lifting units 3 is driven via the linkage unit 4 instead of being directly driven by the driving unit 5, so that a delayed rotation of the threaded rod 303 of the other one of the lifting units 3 may occur (i.e., rotations of the threaded rods 303 of the lifting units 3 are not synchronous with each other), which results in twisting of the linkage rod 401 and unsmooth movement of the working platform unit 2. In addition, the drawback of asynchronous rotation of the threaded rods 303 will be much more apparent if the linkage rod 401 is configured to be longer.

Furthermore, when the working platform unit 2 is arrested when moving downwardly with an object or a user's body part accidentally placed between the working platform unit 2 and a top surface of the cabinet body 1, the continuous operation of the motor 501 which drives the working platform unit 2 to move toward the cabinet body 1 may cause damage to the object or injury to the user's body part, or may even cause breakdown of the driving unit 5.

SUMMARY

Therefore, an object of the disclosure is to provide a tool cabinet that can alleviate at least one of the drawbacks of the prior art.

According to the disclosure, the tool cabinet includes a cabinet body, a working platform unit, two lifting units, and a driving unit. The cabinet body has a top wall, and two spaced-apart guide rails that are respectively disposed proximate to opposite ends of the top wall and that extend in a vertical direction. The working platform unit includes a platform member disposed above the top wall, and two hollow extension members respectively disposed on opposite ends of the platform member, and coupled respectively and telescopically to the guide rails. Each of the extension members has an elongated and non-cylindrical inner coupling hole. The working platform unit is movable relative to the cabinet body between a lowered position, where the platform member is proximate to the top wall, and a lifted position, where the platform member is distal from the top wall. Each of the lifting units includes a guide tube, a support member, a threaded member, and a threaded rod. The guide tube is disposed on the cabinet body and extends in a respective one of the guide rails. The support member is fixedly disposed on a top end of the guide tube and is formed with a connecting hole. The threaded member is disposed above the support member, is disposed in the inner coupling hole of a respective one of the extension members in a manner that the threaded member is non-rotatably movable along the inner coupling hole of the respective one of the extension members. The threaded member is formed with an inner threaded hole. The threaded rod is connected rotatably to the working platform unit, extends in the inner coupling hole of a respective one of the extension members, and engages threadedly the inner threaded hole of the threaded member, so that rotation of the threaded rods of the lifting units results in the movement of the working platform unit between the lowered and lifted positions. The threaded rod extends through the inner threaded hole of the threaded member and the connecting hole of the support member into the guide tube when the working platform unit is at the lowered position. The driving unit is disposed on the working platform unit and includes two driving modules and a control module. Each of the driving modules has a speed reduction mechanism connected to the threaded rod of a respective one of the lifting units, and a motor disposed for driving the speed reduction mechanism to rotate the threaded rod of the respective one of the lifting units. The control module is electrically connected to the motors of the driving modules for driving the motors of the driving modules to operate synchronously. For each of the lifting units, when the working platform unit is arrested in the middle of being driven to move from the lifted position to the lowered position while the driving unit continues to operate, the rotation of the threaded rod is not interrupted and drives the threaded member to slide along the inner coupling hole of the respective one of the extension members away from a top surface of the support member.

BRIEF DESCRIPTION OF THE DRAWINGS

Other features and advantages of the disclosure will become apparent in the following detailed description of the embodiment with reference to the accompanying drawings, of which.

DETAILED DESCRIPTION

Figure 1:
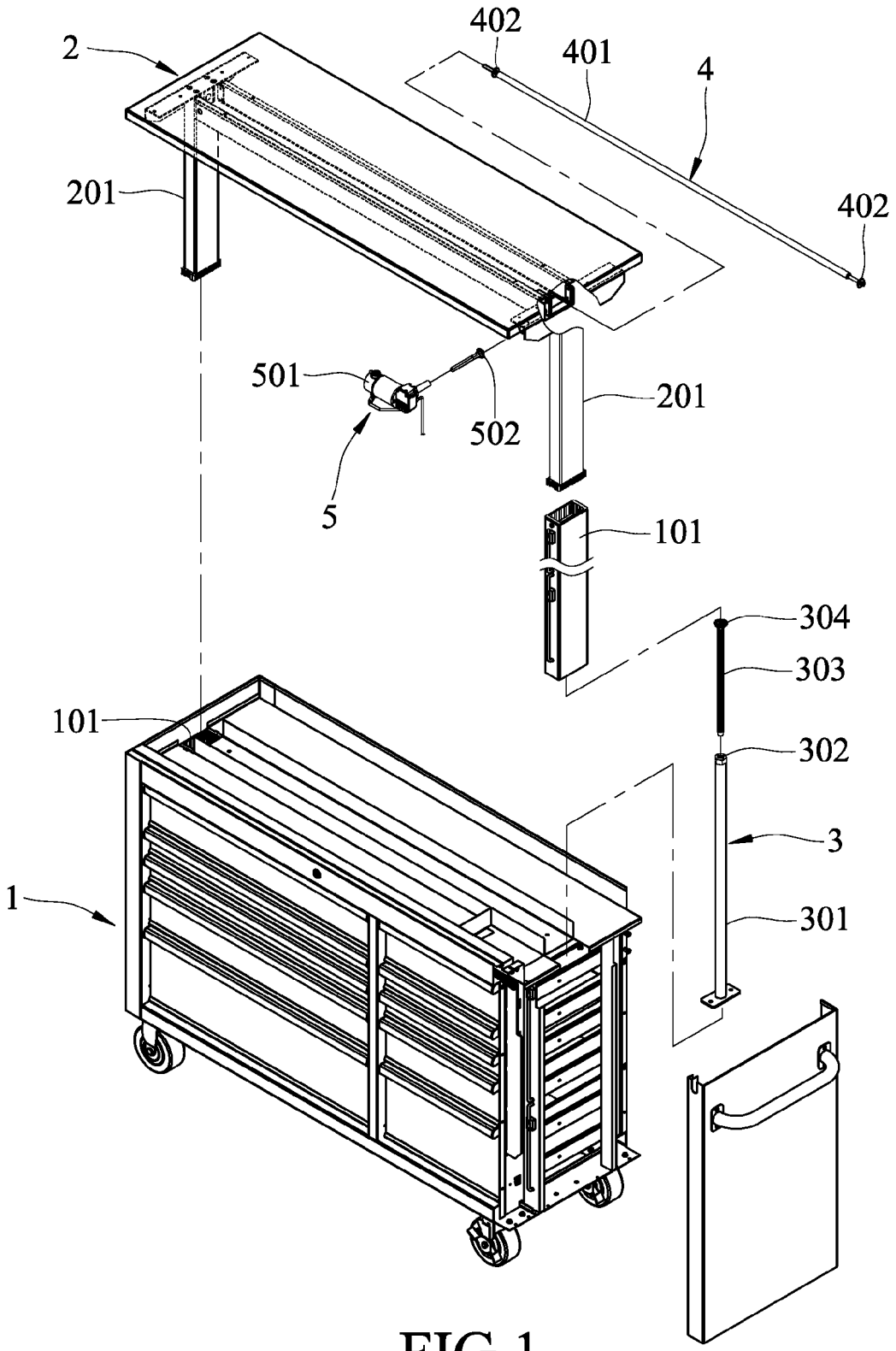
FIG.1 PRIOR ART
FIG. 1 is a partly exploded perspective view of a conventional tool cabinet.
Figure 2:
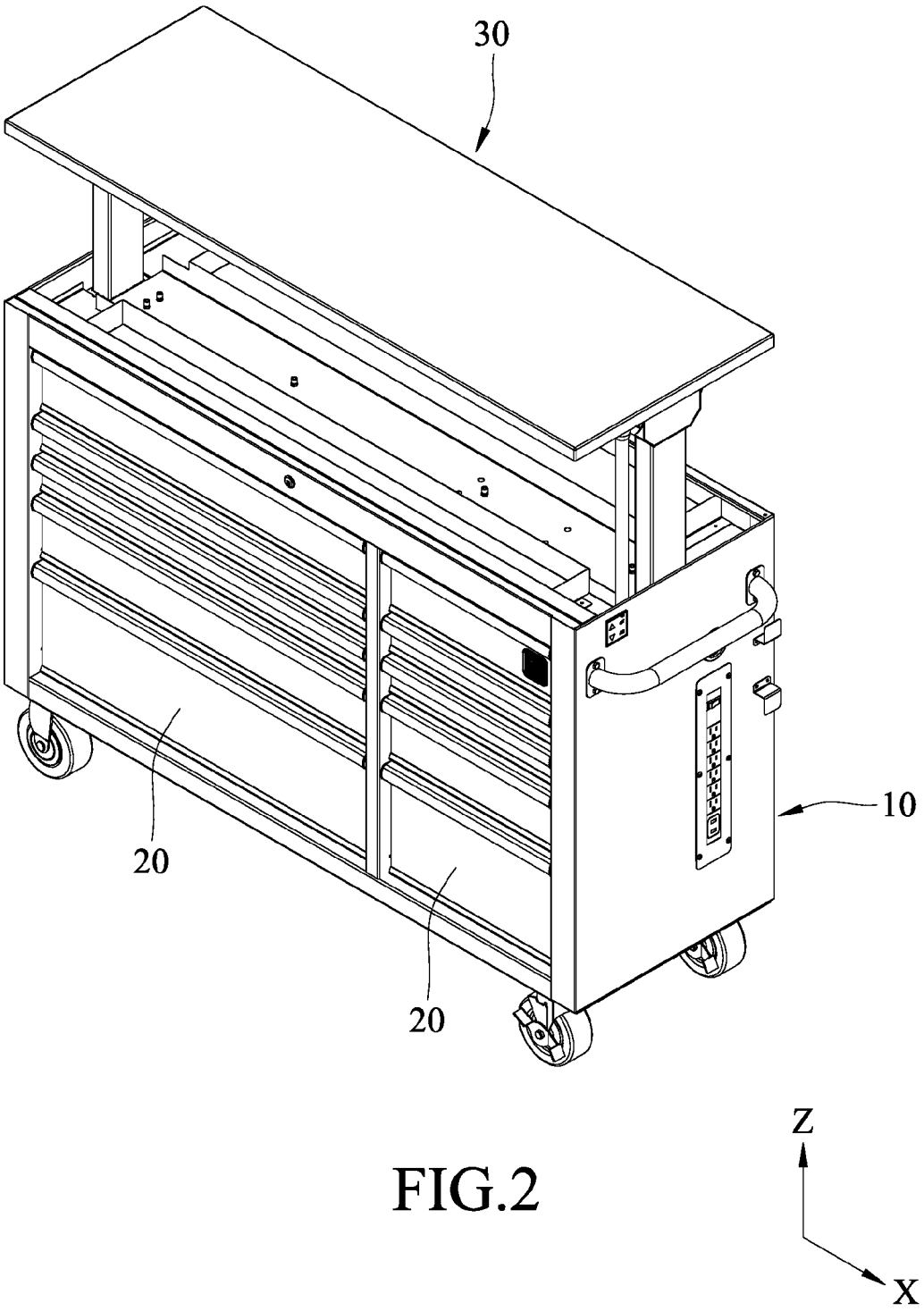
FIG. 2 is a perspective view of an embodiment of a tool cabinet according to the disclosure.
Figure 3:
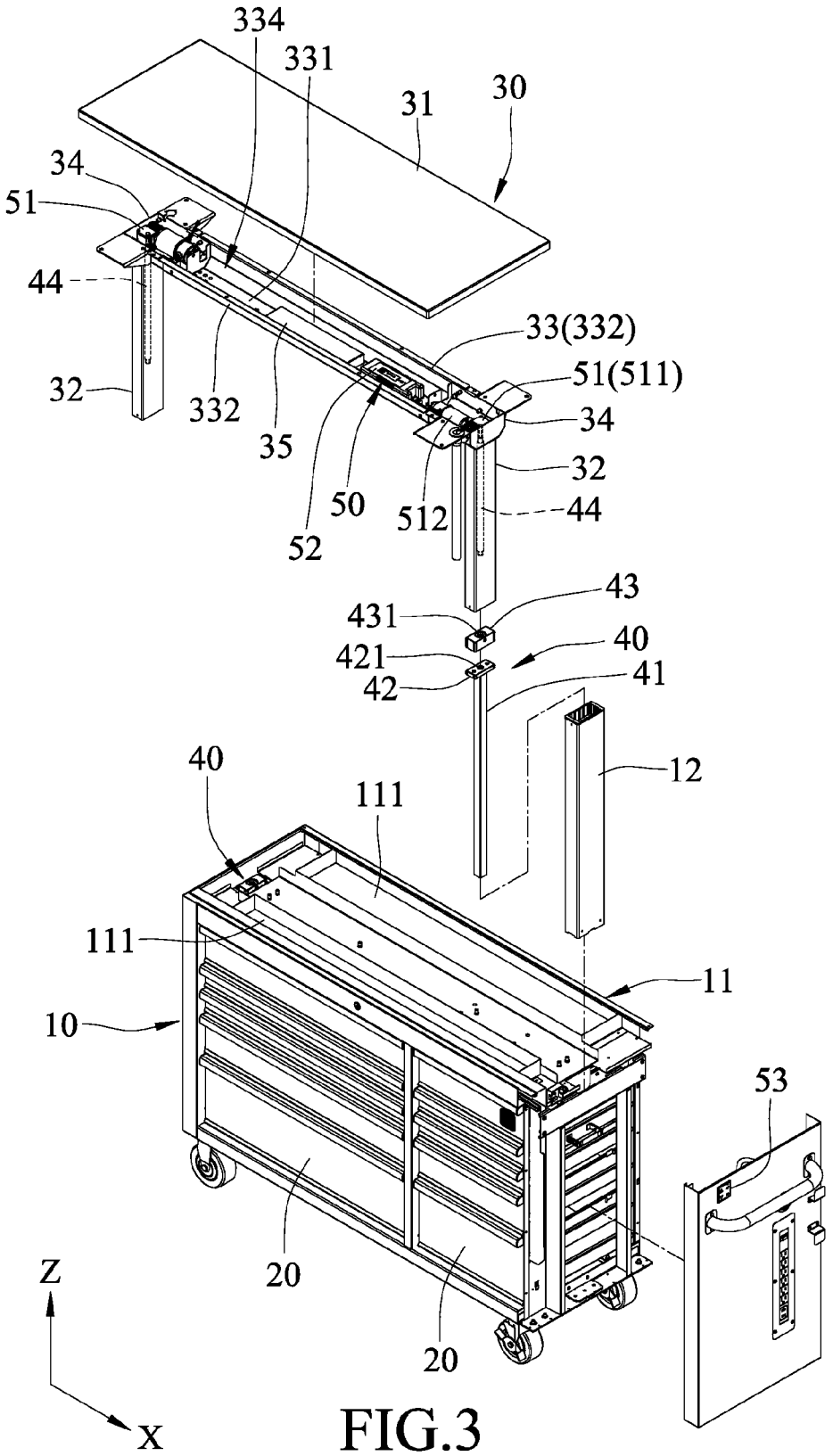
FIG. 3 is a partly exploded perspective view of the embodiment.

Referring to FIGS. 2 and 3, an embodiment of a tool cabinet according to the disclosure includes a cabinet body 10, a plurality of drawers 20, a working platform unit 30, two lifting units 40, and a driving unit 50.

Figure 4:
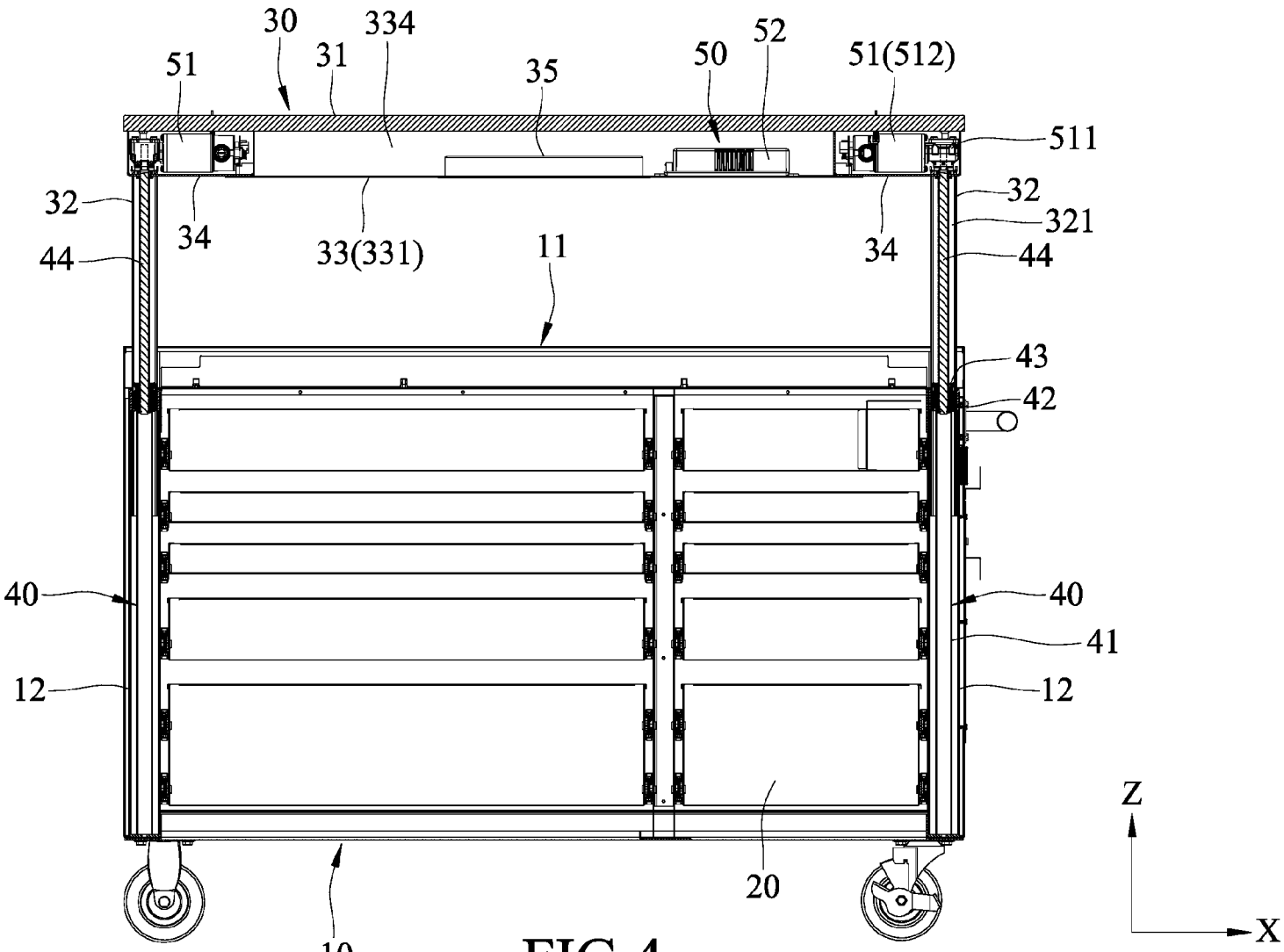
FIG. 4 is a sectional view of the embodiment, illustrating a working platform unit being at a lifted position.
Figure 5:
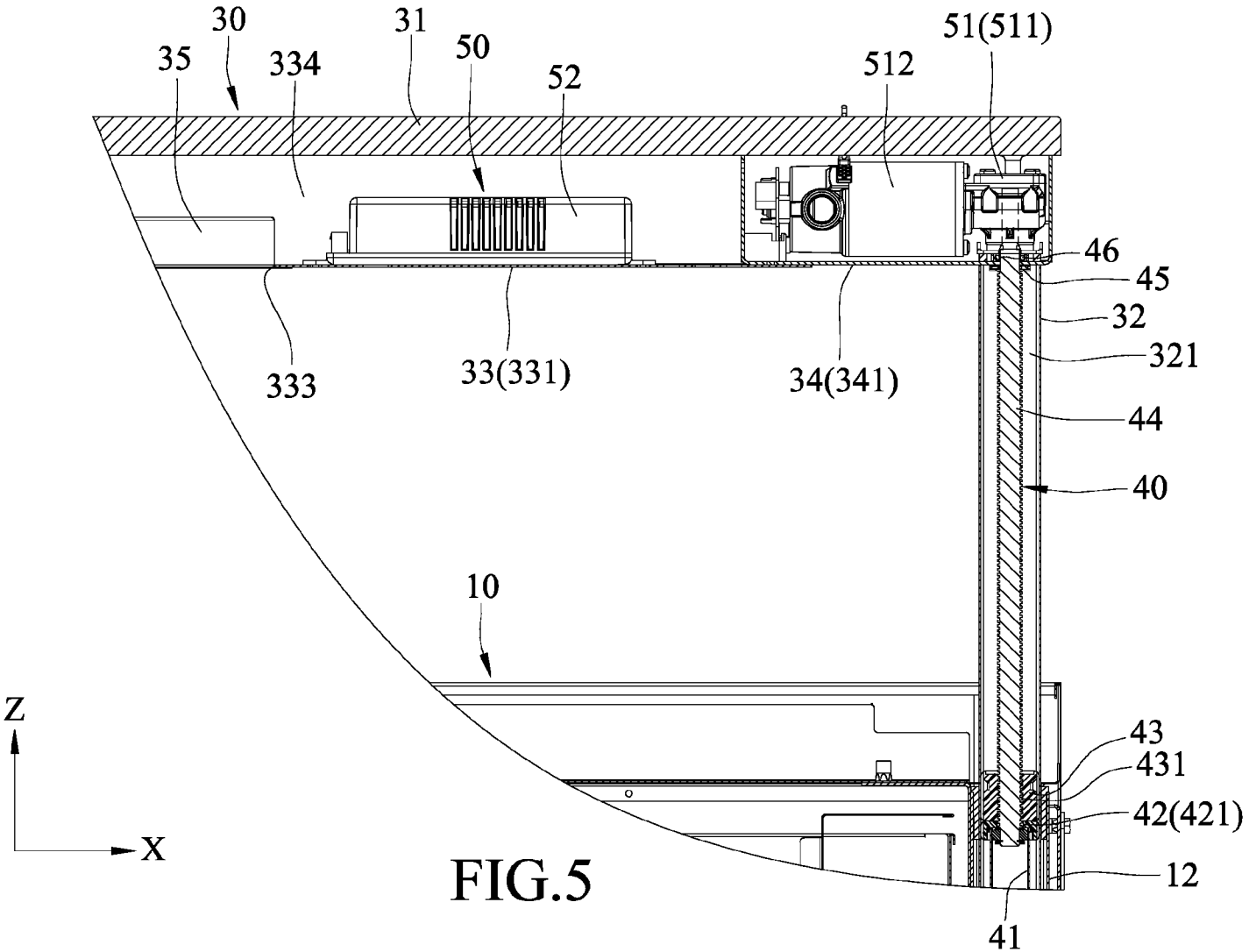
FIG. 5 is a fragmentary enlarged view of FIG. 4.

Referring to FIGS. 3 to 5, the cabinet body 10 includes a top wall 11 and two spaced-apart guide rails 12. The guide rails 12 are respectively disposed proximate to opposite ends of the top wall 11 in a horizontal direction (X), and extend in a vertical direction (Z). The top wall 11 of the cabinet body 10 has a top surface defining a plurality of storage chambers 111 for containing tools (not shown).

The drawers 20 are movably disposed in the cabinet body 10, and are disposed under the top wall 11.

The working platform unit 30 includes a platform member 31, two hollow extension members 32, a hollow cross beam 33, two motor cases 34, and a light case 35. The platform member 31 is disposed above the top wall 11. The extension members 32 are respectively disposed on opposite ends of the platform member 31, and are coupled respectively and telescopically to the guide rails 12. The crossbeam 33 is disposed on a bottom surface of the platform member 31, and has opposite longitudinal ends in the horizontal direction (X). Each of the motor cases 34 is disposed on the bottom surface of the platform member 31, and is connected between a respective one of the longitudinal ends of the cross beam 33 and a respective one of the extension members 32. The light case 35 is disposed on the cross beam 33.

Each of the extension members 32 of the working platform unit 3 has an elongated and non-cylindrical inner coupling hole 321, which is rectangular in this embodiment.

The cross beam 33 has a beam bottom wall 331 having opposite edges that extend in the horizontal direction (X), and two connecting walls 332 respectively and upwardly extending from the opposite edges of the beam bottom wall 331, and cooperating with the beam bottom wall 331 to define a receiving space 334. The beam bottom wall 331 is formed with a through hole 333 communicating with the receiving space 334.

Each of the motor cases 34 is in spatial communication with the receiving space 334 of the cross beam 33, and has a case bottom wall 341. The light case 35 is disposed in the receiving space 334 and engages the through hole 333 of the beam bottom wall 331.

Figure 6:
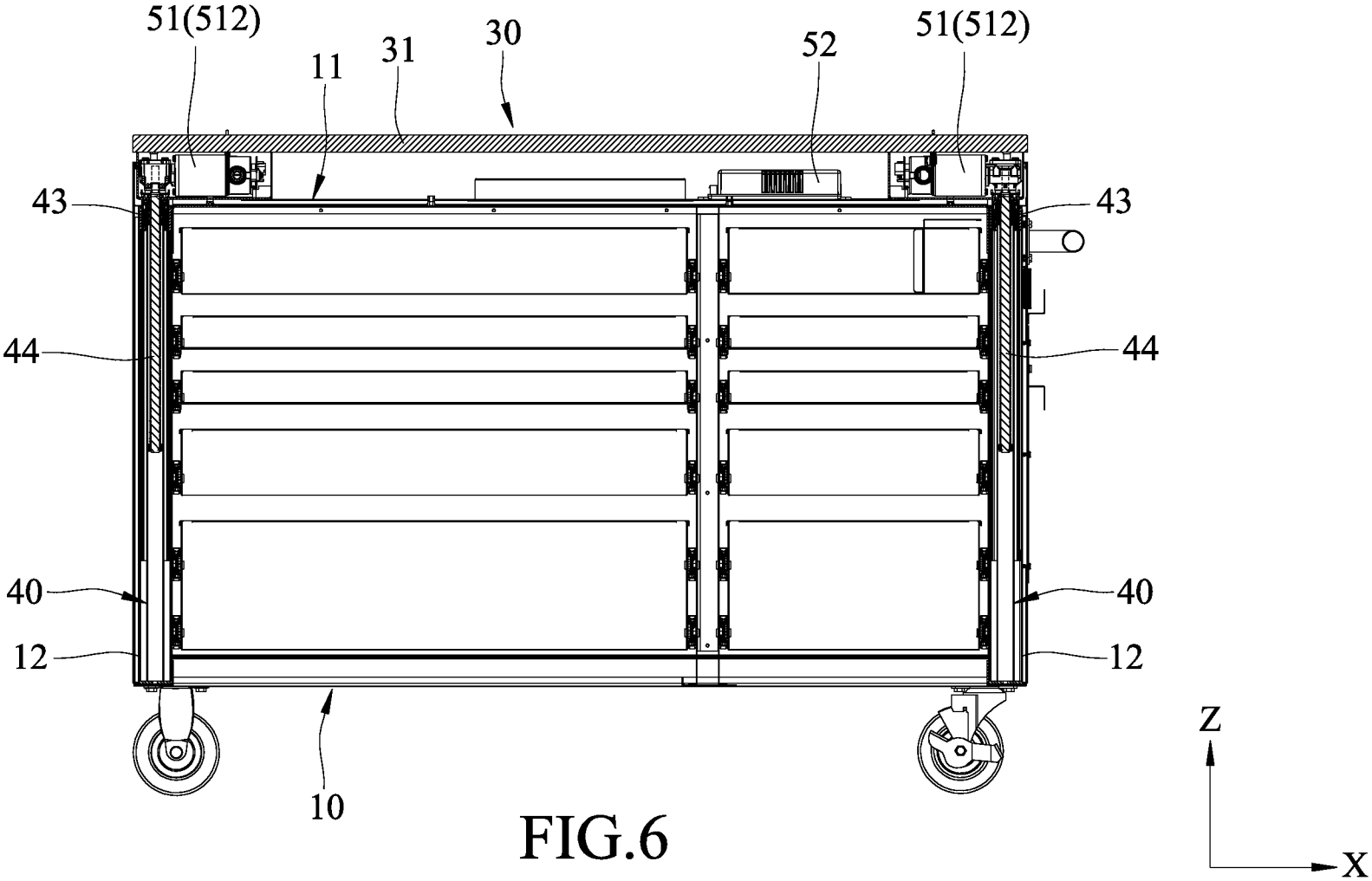
FIG. 6 is a view similar to FIG. 4, but illustrating the working platform unit being at a lowered position.

The working platform unit 30 is movable vertically relative to the cabinet body 10 between a lowered position (see FIG. 6), where the platform member 31 is proximate to the top wall 11, and a lifted position (see FIGS. 4 and 5), where the platform member 31 is distal from the top wall 11.

Each of the lifting units 40 includes a guide tube 41 disposed on the cabinet body 10 and extending in a respective one of the guide rails 12, a support member 42 fixedly disposed on a top end of the guide tube 41 and formed with a connecting hole 421, a threaded member 43 disposed above the support member 42 and formed with an inner threaded hole 431, and a threaded rod 44 connected rotatably to the working platform unit 30. The threaded member 43 is disposed in the inner coupling hole 321 of a respective one of the extension members 32 in a manner that the threaded member 43 is non-rotatably movable along the inner coupling hole 321 of the respective one of the extension members 32. The threaded rod 44 extends in the inner coupling hole 321 of a respective one of the extension members 32, and engages threadedly the inner threaded hole 431 of the threaded member 43, so that rotation of the threaded rods 44 of the lifting units 40 results in the movement of the working platform unit 30 between the lowered and lifted positions. When the working platform unit 30 is at the lowered position, the threaded rod 44 of each of the lifting units 40 extends through the inner threaded hole 431 of the threaded member 43 and the connecting hole 421 of the support member 42 into the guide tube 41 (i.e., the threaded hole 431 is in communication with the connecting hole 421).

In this embodiment, the threaded rod 44 of each of the lifting units 40 extends rotatably through the case bottom wall 341 of a respective one of the motor cases 34 into the respective one of the motor cases 34. Each of the lifting units 40 (only one lifting unit 40 is shown in FIG. 5) further includes a thrust bearing 45 sleeved on the threaded rod 44 and connected to a bottom surface of the case bottom wall 341 of the respective one of the motor cases 34, and a ball bearing 46 sleeved on the threaded rod 44 and connected to a top surface of the case bottom wall 341 of the respective one of the motor cases 34.

The driving unit 50 is disposed on the working platform unit 30, and includes two driving modules 51 respectively disposed in the motor cases 34, a control module 52, and a lifting controller 53 electrically connected to the control module 52. Each of the driving modules 51 has a speed reduction mechanism 511 connected to the threaded rod 44 of a respective one of the lifting units 40, and a motor 512 disposed for driving the speed reduction mechanism 511 to rotate the threaded rod 44 of the respective one of the lifting units 40. In this embodiment, the speed reduction mechanism 511 of each of the driving modules 51 is a speed reduction gearbox, but is not limited thereto in other embodiments.

The control module 52 is received in the receiving space 334 of the cross beam 34, is disposed between the driving modules 51, and is electrically connected to the motors 512 of the driving modules 51 for driving the motors 512 of the driving modules 51 to operate synchronously.

To lift or lower the working platform unit 30, a user needs to press one of the buttons of the lifting controller 53 to transmit a control signal to the control module 52 to initiate the motors 512 of the driving modules 51 to drive synchronized movements of the threaded rods 44 of the lifting units 40 relative to the corresponding threaded members 43. As a result, the working platform unit 30 may be smoothly lifted along the guide rails 12 between the lowered position (see FIG. 6) and the lifted position (see FIG. 4).

Figure 7:
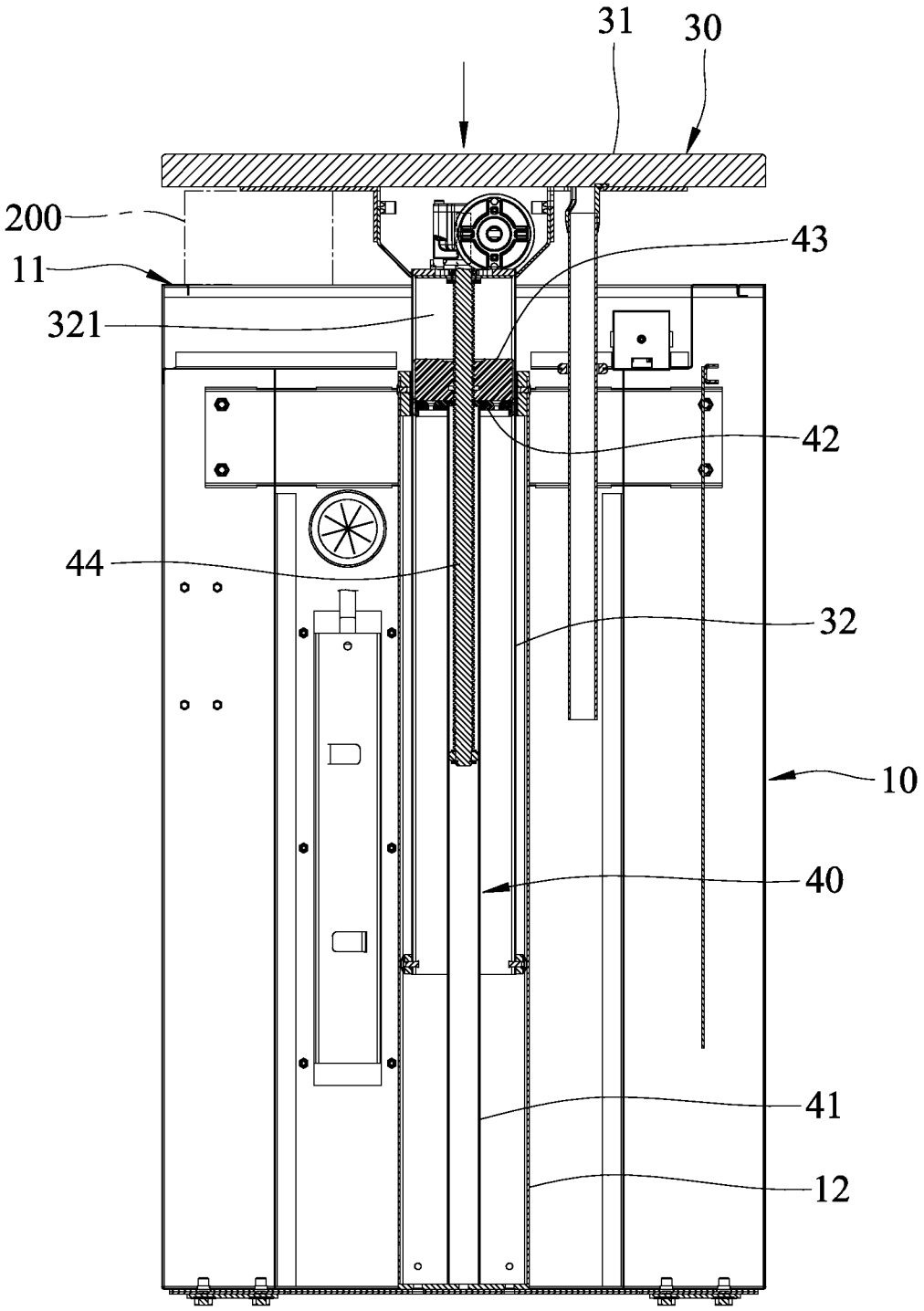
FIG. 7 is another sectional view of the embodiment, illustrating the working platform unit being arrested in the middle of being driven to move from the lifted position to the lowered position.
Figure 8:
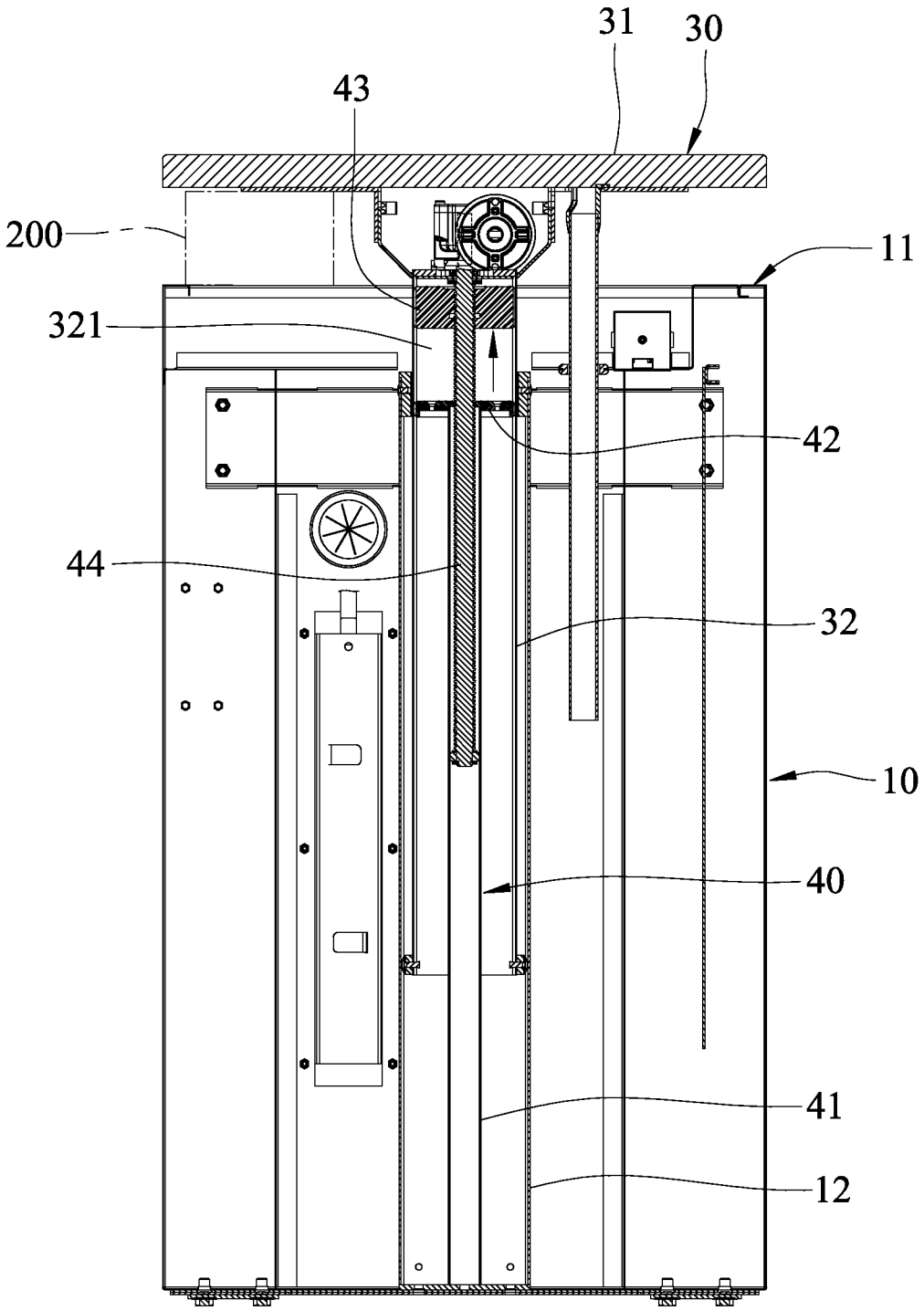
FIG. 8 is a view similar to FIG. 7, but illustrating a threaded member of a lifting unit sliding away from a supporting member of the lifting unit.

Referring to FIGS. 7 and 8, the working platform unit 30 is arrested in the middle of being driven to move from the lifted position to the lowered position by an object 200 (or the user's hand) accidentally placed between the top surface of the top wall 11 of the cabinet body 10 and the bottom surface of the platform member 31 of the working platform unit 30. At this time, for each of the lifting units 40, the rotation of the threaded rod 44 is not interrupted while the driving unit 50 continues to operate, so that the threaded member 43 is driven to slide upwardly along the threaded rod 44 away from a top surface of the support member 42. With the continuous operation of the motors 512 of the driving modules 51 being converted into such upward sliding movement of the threaded members 43 of the lifting units 40, risk of breakdown of the driving unit 50 is effectively reduced. After removal of the object 200, the working platform unit 30 will move to the lowered position by virtue of gravity with the threaded members 43 of the lifting units 40 restoring to contact respectively the top surfaces of the support members 42 of the lifting units 40.

In view of the above description, the advantages of the tool cabinet can be summarized in the following:

1. By virtue of the movable threaded members 43 of the lifting units 40, when the movement of the working platform unit 30 from the lifted position to the lowered position is interrupted, the working platform unit 30 can be effectively stopped without moving further toward the cabinet body 10, and damage to the driving unit 50 can be avoided.

2. By virtue of the synchronous movements of the motors 512 of the driving modules 51 driven by the control module 52, the threaded rods 44 of the lifting units 40 can move synchronously. In comparison with the aforementioned conventional tool cabinet, a delay in rotation of any one of the threaded rods 44 relative to the other one of the threaded rods 44 is effectively prevented, thereby ensuring a smooth movement of the working platform unit 30.

In the description above, for the purposes of explanation, numerous specific details have been set forth in order to provide a thorough understanding of the embodiment. It will be apparent, however, to one skilled in the art, that one or more other embodiments may be practiced without some of these specific details. It should also be appreciated that reference throughout this specification to "one embodiment," "an embodiment," an embodiment with an indication of an ordinal number and so forth means that a particular future, structure, or characteristic may be included in the practice of the disclosure. It should be further appreciated that in the description, various features are sometimes grouped together in a single embodiment, figure, or description thereof for the purpose of streamlining the disclosure and aiding in the understanding of various inventive aspects.

While the disclosure has been described in connection with what is considered the exemplary embodiment, it is understood that this disclosure is not limited to the disclosed embodiment but is intended to cover various arrangements included within the spirit and scope of the broadest interpretation so as to encompass all such modifications and equivalent arrangements.

What is claimed is:

1. A tool cabinet comprising:

a cabinet body including a top wall, and two spaced-apart guide rails that are respectively disposed proximate to opposite ends of said top wall and that extend in a vertical direction;

a working platform unit including a platform member that is disposed above said top wall, and two hollow extension members that are respectively disposed on opposite ends of said platform member and that are coupled respectively and telescopically to said guide rails, each of said extension members having an elongated and non-cylindrical inner coupling hole, said working platform unit being movable relative to said cabinet body between a lowered position, where said platform member is proximate to said top wall, and a lifted position, where said platform member is distal from said top wall;

two lifting units, each of which includes a guide tube that is disposed on said cabinet body, and that extends in a respective one of said guide rails, a support member that is fixedly disposed on a top end of said guide tube, and that is formed with a connecting hole, a threaded member that is disposed above said support member, that is disposed in said inner coupling hole of a respective one of said extension members in a manner that said threaded member is non-rotatably movable along said inner coupling hole of the respective one of said extension members, said threaded member being formed with an inner threaded hole, and a threaded rod that is connected rotatably to said working platform unit, that extends in said inner coupling hole of a respective one of said extension members, and that engages threadedly said inner threaded hole of said threaded member, so that rotation of said threaded rods of said lifting units results in the movement of said working platform unit between the lowered and lifted positions, said threaded rod extending through said inner threaded hole of said threaded member and said connecting hole of said support member into said guide tube when said working platform unit (30) is at the lowered position; and a driving unit disposed on said working platform unit and including two driving modules, each of which has a speed reduction mechanism that is connected to said threaded rod of a respective one of said lifting units, and a motor that is disposed for driving said speed reduction mechanism to rotate said threaded rod of the respective one of said lifting units, and a control module that is electrically connected to said motors of said driving modules for driving said motors of said driving modules to operate synchronously;

wherein, for each of said lifting units, when said working platform unit is arrested in the middle of being driven to move from the lifted position to the lowered position while said driving unit continues to operate, the rotation of said threaded rod is not interrupted and drives said threaded member to slide along said inner coupling hole of the respective one of said extension members away from a top surface of said support member.

2. The tool cabinet as claimed in claim 1, wherein:

said working platform unit further includes a hollow cross beam disposed on a bottom surface of said platform member, defining a receiving space, and having opposite longitudinal ends in a horizontal direction, and two motor cases disposed on said bottom surface of said platform member, each of said motor cases being connected between a respective one of said longitudinal ends of said cross beam and a respective one of said extension members, and being in communication with said receiving space;

said driving modules are respectively disposed in said motor cases; and said control module is received in said receiving space and is disposed between said driving modules.

3. The tool cabinet as claimed in claim 2, wherein said threaded rod of each of said lifting units extends rotatably into a respective one of said motor cases.

4. The tool cabinet as claimed in claim 3, wherein:

each of said motor cases has a case bottom wall; and each of said lifting units further includes a thrust bearing sleeved on said threaded rod and connected to a bottom surface of said case bottom wall of the respective one of said motor cases, and a ball bearing sleeved on said threaded rod and connected to a top surface of said case bottom wall of the respective one of said motor cases.

5. The tool cabinet as claimed in claim 4, wherein said cross beam has:

a beam bottom wall having opposite edges that extend in the horizontal direction; and two connecting walls respectively and upwardly extending from said opposite edges of said beam bottom wall, and cooperating with said beam bottom wall to define said receiving space of said cross beam.

6. The tool cabinet as claimed in claim 5, wherein:

said beam bottom wall of said cross beam is formed with a through hole communicating with said receiving space; and said working platform unit further includes a light case received in said receiving space and engaging said through hole.

7. The tool cabinet as claimed in claim 1, wherein said top wall of said cabinet body has a top surface defining a plurality of storage chambers.

8. The tool cabinet as claimed in claim 1, further comprising a plurality of drawers movably disposed in said cabinet body and disposed under said top wall.

* * * * *